US012420901B2

(12) United States Patent
Kimpara et al.

(10) Patent No.: US 12,420,901 B2
(45) Date of Patent: Sep. 23, 2025

(54) SHIP PROPULSION MACHINE AND SHIP PROPULSION MACHINE SET

(71) Applicant: SUZUKI MOTOR CORPORATION, Hamamatsu (JP)

(72) Inventors: Masatoshi Kimpara, Hamamatsu (JP); Takuya Sato, Hamamatsu (JP)

(73) Assignee: SUZUKI MOTOR CORPORATION, Hamamatsu (JP)

( * ) Notice: Subject to any disclaimer, the term of this patent is extended or adjusted under 35 U.S.C. 154(b) by 605 days.

(21) Appl. No.: 17/943,854

(22) Filed: Sep. 13, 2022

(65) Prior Publication Data

US 2023/0086934 A1 Mar. 23, 2023

(30) Foreign Application Priority Data

Sep. 17, 2021 (JP) ..... 2021-152544

(51) Int. Cl.

| | |
|---|---|
| ***B63H 20/28*** | (2006.01) |
| ***B63H 5/125*** | (2006.01) |
| ***B63H 11/08*** | (2006.01) |
| *B63H 20/32* | (2006.01) |

(52) U.S. Cl.

CPC ..... *B63H 20/28* (2013.01); *B63H 5/125* (2013.01); *B63H 11/08* (2013.01); *B63H 2020/323* (2013.01)

(58) Field of Classification Search

CPC ..... B63H 20/32; B63H 2020/323; B63H 20/001; B63H 20/002; B63H 20/28; B63H 20/285; B63H 20/30

See application file for complete search history.

(56) References Cited

U.S. PATENT DOCUMENTS

| | | | | |
|---|---|---|---|---|
| 2,676,559 | A * | 4/1954 | Davies | B63H 20/245 123/195 P |
| 11,345,456 | B2 * | 5/2022 | Kjellman | B63H 21/383 |
| 12,296,933 | B2 * | 5/2025 | Saruwatari | B63H 20/14 |
| 2009/0235877 | A1 * | 9/2009 | Cohen | F28D 1/022 440/88 C |
| 2015/0111447 | A1 * | 4/2015 | Sacker | B63H 23/06 440/49 |
| 2019/0249590 | A1 * | 8/2019 | Li | H02K 5/203 |
| 2024/0278892 | A1 * | 8/2024 | Sorkin | B63H 20/14 |

FOREIGN PATENT DOCUMENTS

| | | | | |
|---|---|---|---|---|
| JP | 2005-153727 | A | 6/2005 | |
| WO | WO-2025071561 | A1 * | 4/2025 | B63H 20/14 |

* cited by examiner

*Primary Examiner* — Andrew Polay
(74) *Attorney, Agent, or Firm* — Stein IP LLC

(57) ABSTRACT

A ship propulsion machine includes a ship propulsion machine main body and a propulsion module. The ship propulsion machine main body includes a power source, a tank storing cooling liquid, a heat sink cooling the cooling liquid, a cooling liquid passage connecting the power source and the heat sink, a pump causing the cooling liquid to flow in the cooling liquid passage, a first housing part housing the heat sink. The propulsion module includes a drive shaft rotated by the power source and a propulsion device converting rotation of the drive shaft into the propulsion force. A connection mechanism separably connecting an output shaft of the power source and the drive shaft is provided on the power source and on the drive shaft. The first housing part and the propulsion device are provided with an attachment mechanism detachably attaching the propulsion module.

4 Claims, 10 Drawing Sheets

SHIP PROPULSION MACHINE AND SHIP PROPULSION MACHINE SET

CROSS-REFERENCE TO RELATED APPLICATIONS

The disclosure of Japanese Patent Application No. 2021-152544 filed on Sep. 17, 2021, including specification, drawings and claims is incorporated herein by reference in its entirety.

BACKGROUND

The present invention relates to a ship propulsion machine and a ship propulsion machine set in which a plurality of types of propulsion modules can be selectively attached to a ship propulsion machine main body.

In general, methods of generating a propulsion force of a ship include a propeller method using a propeller and a water jet method using a water jet propulsion device. Both a ship propulsion machine adopting the propeller method and a ship propulsion machine adopting the water jet method are widespread.

When the propeller method and the water jet method are compared, the propeller method is more advantageous in terms of enhancing propulsion efficiency. However, the propeller method may not be used in a place where a water depth is shallow where a blade of a propeller hits a water bottom. In this regard, the water jet method can be used even in a place where the water depth is shallow because a duct for generating a jet flow is positioned near a water surface.

The ship propulsion machine includes an internal combustion engine or an electric motor as a power source. Such a power source generates heat during operation. Therefore, for many ship propulsion machines, a cooling device that cools the power source is provided.

Patent Literature 1 below discloses an outboard motor including such a cooling device. The cooling device in the outboard motor disclosed in Patent Literature 1 includes a water jacket provided around an electric motor that is disposed above a water surface as a power source, a cooling liquid pump provided in a lower case disposed below the water surface, and a cooling liquid pipe connecting the water jacket and the cooling liquid pump. In addition, the lower case is provided with a water inlet for taking in external water. In the cooling device, the cooling liquid pump takes in the external water from the water inlet as cooling liquid, and pressure-feeds the cooling liquid via the cooling liquid pipe to the water jacket. The cooling liquid flows in the water jacket to cool the electric motor. The cooling liquid after cooling the electric motor is discharged to an outside.

Patent Literature 1: JP-A-2005-153727

SUMMARY

The present invention provides a ship propulsion machine including a ship propulsion machine main body, and a propulsion module configured to generate a propulsion force of a ship using power generated by the ship propulsion machine main body. The ship propulsion machine main body includes a power source, a tank configured to store cooling liquid that cools the power source, a heat sink that cools the cooling liquid, a cooling liquid passage connecting the power source and the heat sink such that the cooling liquid circulates between the power source and the heat sink, a pump configured to cause the cooling liquid to flow in the cooling liquid passage, a mount supporting the power source, the tank, and the pump, and a first housing part disposed below the mount and housing the heat sink. The propulsion module includes a drive shaft extending in an upper-lower direction and configured to be rotated by power of the power source and a propulsion device connected to a lower end side of the drive shaft and configured to convert rotation of the drive shaft into the propulsion force of the ship. The first housing part is provided with a shaft insertion portion into which the drive shaft is removably inserted. A connection mechanism that separably connects an output shaft of the power source and the drive shaft is provided on the power source and on an upper end side of the drive shaft. The first housing part and the propulsion device are provided with an attachment mechanism detachably attaches the propulsion module to a lower portion of the first housing part.

The present invention provides a ship propulsion machine set including a ship propulsion machine main body, a propeller propulsion module configured to generate a propulsion force of a ship using power generated by the ship propulsion machine main body, and a water jet propulsion module configured to generate the propulsion force of the ship using the power generated by the ship propulsion machine main body. The ship propulsion machine set is used by selecting one of the propeller propulsion module and the water jet propulsion module and attaching the selected module to the ship propulsion machine main body. The ship propulsion machine main body includes a power source, a tank configured to store cooling liquid that cools the power source, a heat sink that cools the cooling liquid, a cooling liquid passage connecting the power source and the heat sink such that the cooling liquid circulates between the power source and the heat sink, a pump configured to cause the cooling liquid to flow in the cooling liquid passage, a mount supporting the power source, the tank, and the pump, and a first housing part disposed below the mount and housing the heat sink. The propeller propulsion module includes a first drive shaft extending in an upper-lower direction and configured to be rotated by power of the power source, a gear mechanism to which a lower end side of the first drive shaft is connected, a propeller shaft connected to the gear mechanism, a propeller attached to the propeller shaft, and a second housing part housing the gear mechanism and the propeller shaft. The water jet propulsion module includes a second drive shaft extending in the upper-lower direction and configured to be rotated by the power of the power source, a duct, and an impeller that is provided in the duct and configured to be rotated by rotation of the second drive shaft and to generate a jet flow, the first housing part is provided with a shaft insertion portion into which the first drive shaft and the second drive shaft are configured to be selectively inserted, a connection mechanism configured to selectively connect the first drive shaft and the second drive shaft to an output shaft of the power source is provided on the power source, an upper end side of the first drive shaft, and an upper end side of the second drive shaft, and the first housing part, the second housing part, and the duct are provided with an attachment mechanism to which the propeller propulsion module and the water jet propulsion module are configured to be selectively attached to a lower portion of the first housing part.

BRIEF DESCRIPTION OF DRAWINGS

FIGS. 1A and 1B are views showing an outboard motor set that is an embodiment of a ship propulsion machine set of the present invention, in which FIG. 1A shows a configuration of the outboard motor set, and FIG. 1B shows a usage mode of the outboard motor set.

FIGS. 9A and 9B are views showing a water jet propulsion module according to the embodiment of the present invention, in which FIG. 9A shows a state in which a cross section of the water jet propulsion module cut by a plane including the axial center of a drive shaft and extending in the upper-lower direction and the front-rear direction is viewed from a left side thereof, and FIG. 9B shows a state in which the water jet propulsion module is viewed from a lower side thereof.

DESCRIPTION OF EMBODIMENTS

Figure 1A:
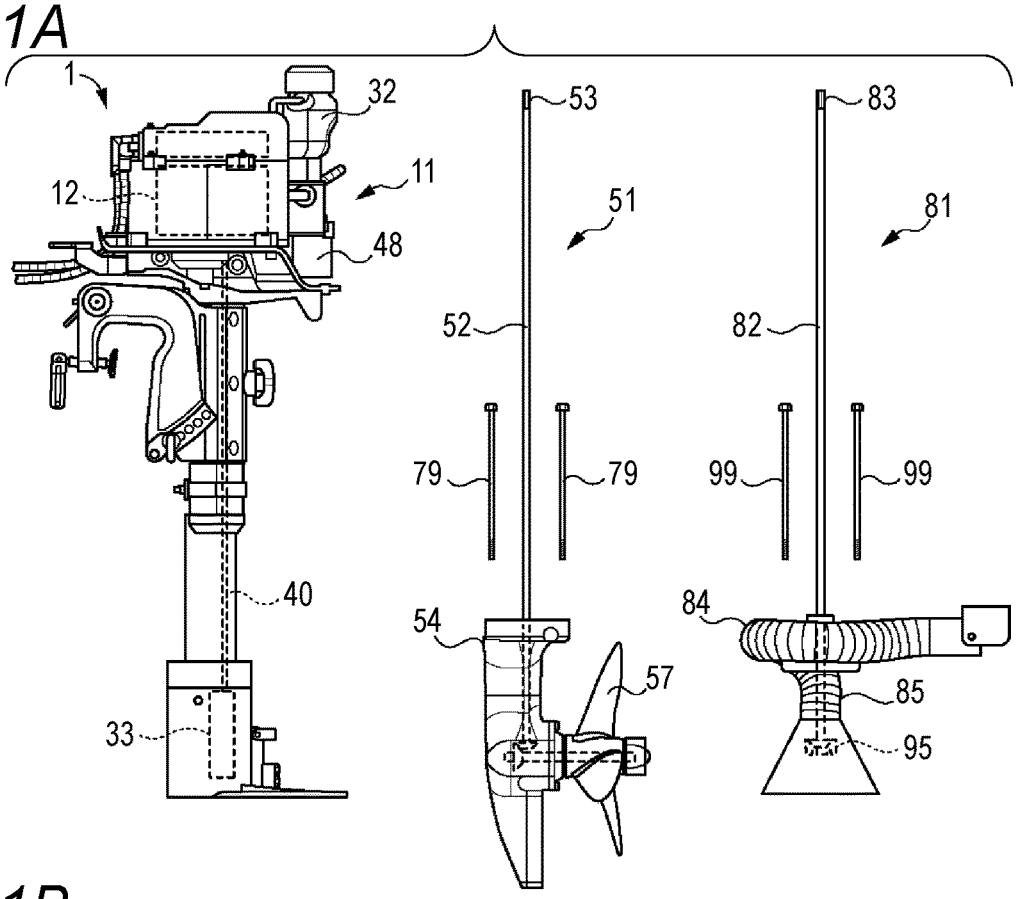

In a ship propulsion machine, a propulsion module including a portion that uses power of a power source to generate a propulsion force of a ship can be attached to and detached from a ship propulsion machine main body including a portion including the power source, a propeller propulsion module adopting a propeller method and a water jet propulsion module adopting a water jet method are prepared as the propulsion module, and if any one of the propeller propulsion module and the water jet propulsion module can be selected and attached to the ship propulsion machine main body, convenience of the ship propulsion machine can be improved. For example, the ship propulsion machine may be normally used in a state where the propeller propulsion module having high propulsion efficiency is attached to the ship propulsion machine main body, and when sailing in shallow water, the ship propulsion machine may be used in a state where the water jet propulsion module is attached to the ship propulsion machine main body instead of the propeller propulsion module.

However, as in the outboard motor disclosed in Patent Literature 1, in the ship propulsion machine in which the cooling liquid pump is provided in the lower case disposed below the water surface, in a case where the propulsion module can be attached to and detached from the ship propulsion machine main body, the following problem arises.

In the ship propulsion machine adopting the propeller method, a portion that uses the power of the power source to generate the propulsion force of the ship, that is, a propeller shaft, a propeller, and the like are provided in the lower case of the ship propulsion machine. Therefore, the entire lower case provided with the propeller shaft and the propeller is preferably used as the propulsion module. Thus, by providing the ship propulsion machine with a structure in which the entire lower case is detachably attached to the ship propulsion machine main body, attachment and detachment of the propulsion module to and from the ship propulsion machine main body is implemented. However, in a case where the cooling liquid pump is provided in the lower case, when the lower case is separated from the ship propulsion machine main body, cooling liquid pipes connecting the water jacket provided on a ship propulsion machine main body side and the cooling liquid pump provided on a lower case side are divided. Therefore, when the propulsion module separated from the ship propulsion machine main body is attached to the ship propulsion machine main body, an operation of connecting the cooling liquid pipe on the ship propulsion machine main body side and the cooling liquid pipe on a propulsion module side is required, and an operation of attaching and detaching the propulsion module to and from the ship propulsion machine main body may be complicated.

The present invention is made in view of, for example, the above problems, and an object of the present invention is to provide a ship propulsion machine and a ship propulsion machine set in which a propulsion module can be easily attached to and detached from a ship propulsion machine main body.

According to the present invention, it is possible to easily attach and detach the propulsion module to and from the ship propulsion machine main body.

A ship propulsion machine according to an embodiment of the present invention includes a ship propulsion machine main body and a propulsion module that uses power generated by the ship propulsion machine main body to generate a propulsion force of a ship. The ship propulsion machine main body includes a power source, a tank that stores cooling liquid that cools the power source, a heat sink that cools the cooling liquid, a cooling liquid passage that connects the power source and the heat sink such that the cooling liquid circulates between the power source and the heat sink, a pump that causes the cooling liquid to flow in the cooling liquid passage, a mount that supports the power source, the tank, and the pump, and a first housing part that is disposed below the mount and houses the heat sink. The propulsion module includes a drive shaft that extends in an upper-lower direction and is configured to be rotated by power of the power source, and a propulsion device that is connected to a lower end side of the drive shaft and configured to convert rotation of the drive shaft into the propulsion force of the ship. The first housing part is provided with a shaft insertion portion into which the drive shaft is removably inserted. A connection mechanism that separably connects an output shaft of the power source and the drive shaft is provided on the power source and on an upper end side of the drive shaft. The first housing part and the propulsion device are provided with an attachment mechanism that detachably attaches the propulsion module to a lower portion of the first housing part.

In addition, the ship propulsion machine set according to the embodiment of the present invention includes a ship propulsion machine main body, a propeller propulsion module that uses power generated by the ship propulsion machine main body to generate a propulsion force of a ship, and a water jet propulsion module that uses the power generated by the ship propulsion machine main body to generate the propulsion force of the ship. The ship propulsion machine set is used by selecting one of the propeller propulsion module and the water jet propulsion module and attaching the selected module to the ship propulsion machine main body. The ship propulsion machine main body includes a power source, a tank, a heat sink, a cooling liquid passage, a pump, a mount, and a first housing part, similarly to the ship propulsion machine main body of the ship propulsion machine according to the embodiment of the present invention above. The propeller propulsion module includes a first drive shaft that extends in an upper-lower direction and is configured to be rotated by power of the power source, a gear mechanism to which a lower end side of the first drive shaft is connected, a propeller shaft connected to the gear mechanism, a propeller attached to the propeller shaft, and a second housing part that houses the gear mechanism and the propeller shaft. The water jet propulsion module includes a second drive shaft that extends in the upper-lower direction and is configured to be rotated by the power of the power source, a duct, and an impeller that is provided in the duct and rotates by rotation of the second drive shaft to generate a jet flow. The first housing part is provided with a shaft insertion portion into which the first drive shaft and the second drive shaft are configured to be selectively inserted. A connection mechanism configured to selectively connect the first drive shaft and the second drive shaft to an output shaft of the power source is provided on the power source, an upper end side of the first drive shaft, and an upper end side of the second drive shaft. The first housing part, the second housing part, and the duct are provided with an attachment mechanism to which the propeller propulsion module and the water jet propulsion module are configured to be selectively attached to a lower portion of the first housing part.

According to the ship propulsion machine or the ship propulsion machine set of the embodiment of the present invention, a user can form a propeller ship propulsion machine by attaching the propeller propulsion module to the ship propulsion machine main body, and can form a water jet ship propulsion machine by attaching the water jet propulsion module to the ship propulsion machine main body. For example, when a sailing area is a deep water area, the user attaches the propeller propulsion module to the ship propulsion machine main body to form the propeller ship propulsion machine, and attaches the propeller ship propulsion machine to a transom of the ship to sail. Accordingly, the user can sail at a high speed based on high propulsion efficiency of the propeller propulsion device. On the other hand, when the sailing area is a shallow water area, the user forms the water jet ship propulsion machine by attaching the water jet propulsion module, instead of the propeller propulsion module, to the ship propulsion machine main body, and attaches the water jet ship propulsion machine to the transom of the ship to sail. Accordingly, when the propeller propulsion device is used, the user can sail even in an area where a water depth is so shallow that a blade of a propeller hits a water bottom.

According to the ship propulsion machine or the ship propulsion machine set of the present embodiment, since all components of a cooling device are provided in the ship propulsion machine main body, the user can easily attach and detach the propulsion module to and from the ship propulsion machine main body. That is, by separating the propulsion module from the ship propulsion machine main body, the components of the cooling device are not divided into a ship propulsion machine main body side and a propulsion module side. Therefore, for example, when the propulsion module separated from the ship propulsion machine main body is attached to the ship propulsion machine main body, the user does not need to perform a complicated operation of connecting a cooling liquid pipe provided on the ship propulsion machine main body side and a cooling liquid pipe provided on the propulsion module side.

EMBODIMENT

Hereinafter, an outboard motor, which is an embodiment of a ship propulsion machine of the present invention, and an outboard motor set, which is an embodiment of a ship propulsion machine set of the present invention, will be described with reference to the drawings. In the embodiment, when directions of front (Fd), rear (Bd), left (Ld), right (Rd), upper (Ud), and lower (Dd) are described, arrows drawn at a lower right in FIGS. 2 to 10 are followed.

(Outboard Motor Set)

FIG. 1A shows an outboard motor set 1 according to the embodiment of the present invention. As shown in FIG. 1A, the outboard motor set 1 includes an outboard motor main body 11, a propeller propulsion module 51 that uses power generated by the outboard motor main body 11 to generate a propulsion force of a ship, and a water jet propulsion module 81 that uses the power generated by the outboard motor main body 11 to generate the propulsion force of the ship.

The outboard motor main body 11 includes an electric motor 12 as a power source and a cooling device (a tank 32, a heat sink 33, a cooling liquid passage 40, a pump 48, and the like) that cools the electric motor 12 and the like.

The propeller propulsion module 51 includes a drive shaft 52 that is rotated by power of the electric motor 12, a propeller propulsion device 54 that converts rotation of the drive shaft 52 into the propulsion force of the ship using a propeller 57, and attachment bolts 79 for attaching the propeller propulsion module 51 to the outboard motor main body 11.

The water jet propulsion module 81 includes a drive shaft 82 that is rotated by the power of the electric motor 12, a water jet propulsion device 84 that converts rotation of the drive shaft 82 into the propulsion force of the ship using a duct 85 and an impeller 95. and attachment bolts 99 for attaching the water jet propulsion module 81 to the outboard motor main body 11.

Figure 1B:
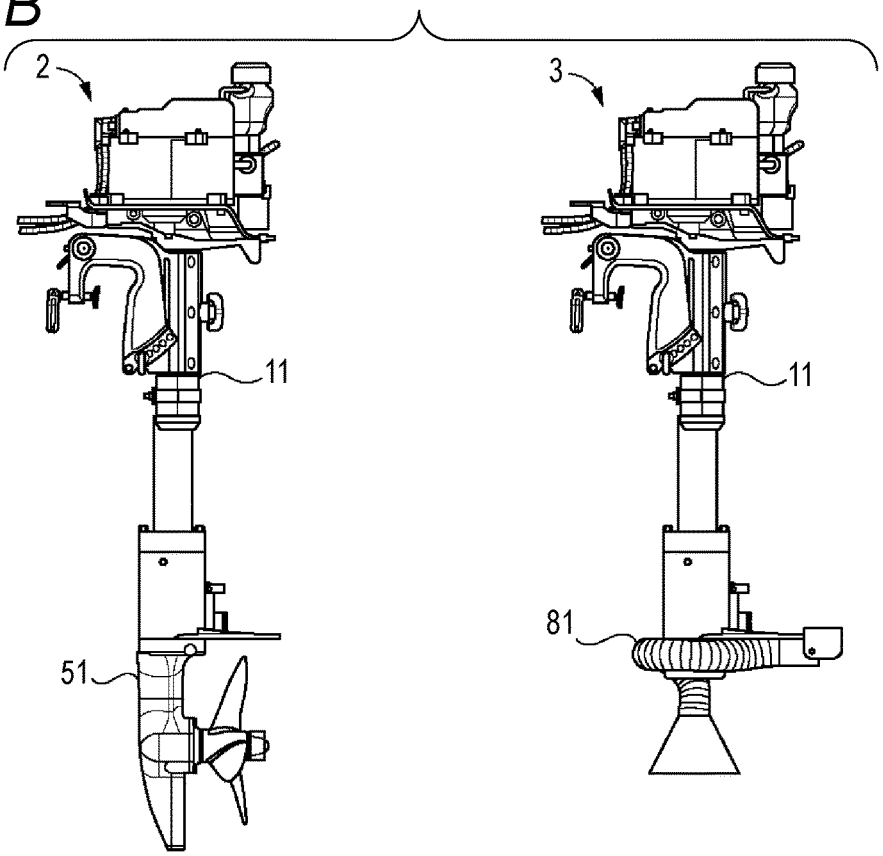

FIG. 1B shows a usage mode of the outboard motor set 1. The outboard motor set 1 is used by selecting one of the propeller propulsion module 51 and the water jet propulsion module 81 and attaching the selected module to the outboard motor main body 11. As shown in FIG. 1B, a user can form a propeller outboard motor 2 by attaching the propeller propulsion module 51 to the outboard motor main body 11. In addition, the user can form a water jet outboard motor 3 by attaching the water jet propulsion module 81 to the outboard motor main body 11.

(Outboard Motor Main Body)

Figure 2:
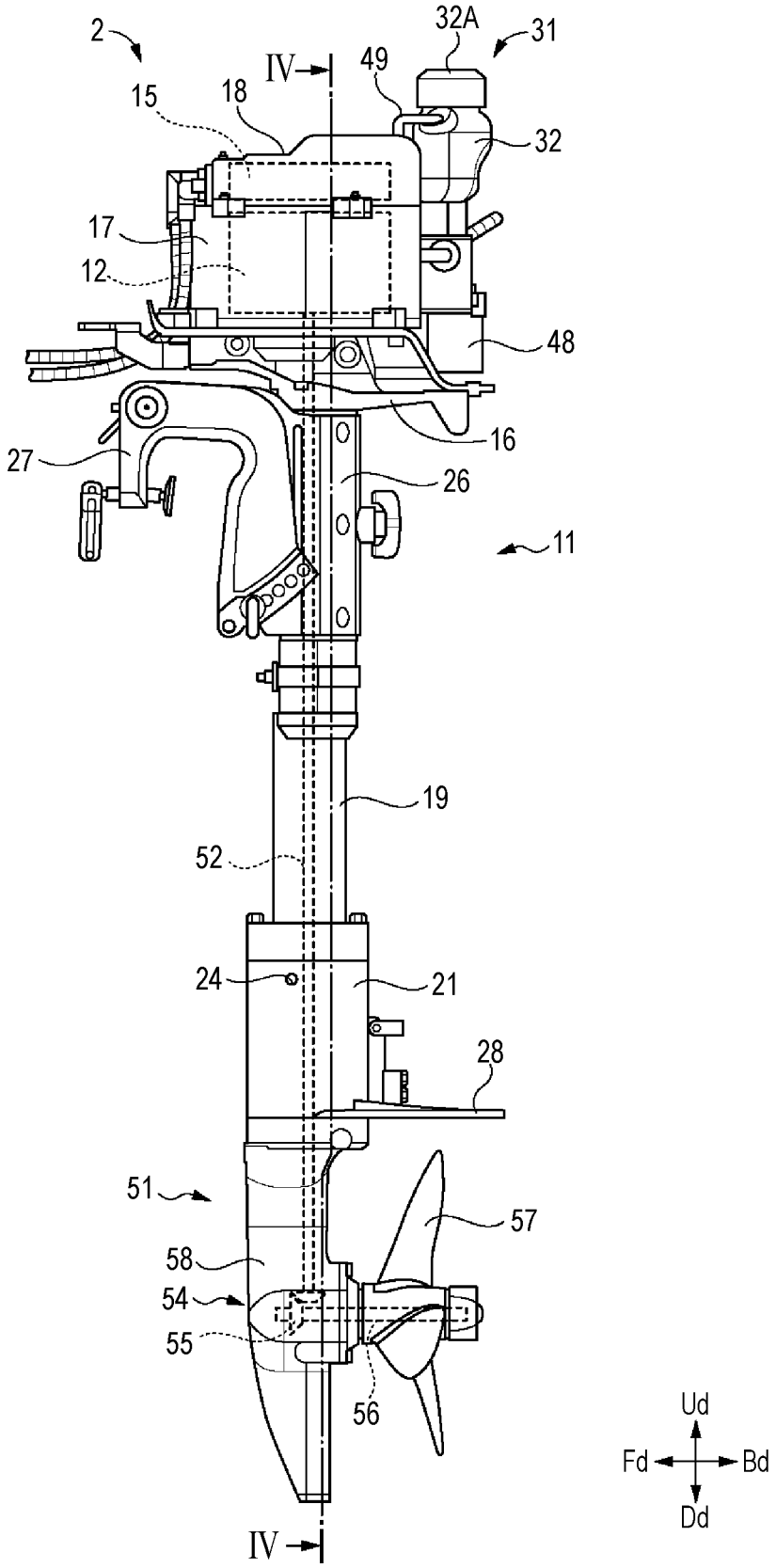
FIG. 2 is a view showing an outboard motor main body to which a propeller propulsion module according to the embodiment of the present invention is attached, as viewed from a left side thereof.

FIG. 2 shows a state in which the outboard motor main body 11 to which the propeller propulsion module 51 is attached is viewed from a left side thereof. As shown in FIG.

2, the outboard motor main body 11 includes the electric motor 12, an inverter 15, and a cooling device 31.

The electric motor 12 is, for example, a brushless motor. The inverter 15 is a circuit that controls driving of the electric motor 12. The cooling device 31 is a device that cools the electric motor 12 and the inverter 15.

The outboard motor main body 11 includes a mount 16, a motor case 17, an inverter case 18, a drive shaft housing 19, and a heat sink case 21.

The mount 16 is a member that supports the electric motor 12, the inverter 15, and the tank 32, the pump 48, and the like in the cooling device 31, and is disposed on an upper portion of the outboard motor main body 11. The electric motor 12 is fixed on the mount 16. The motor case 17 is positioned above the mount 16, is attached to the mount 16, and covers the electric motor 12. The inverter 15 is disposed above the electric motor 12. The inverter case 18 is positioned above the motor case 17, is attached to the motor case 17, and covers the inverter 15. The tank 32 is attached to a rear portion of the inverter case 18, and the pump 48 is attached to a rear portion of the motor case 17.

The drive shaft housing 19 is a cylindrical member extending in an upper-lower direction. The drive shaft housing 19 is disposed below the mount 16 and is coupled to a lower portion of the mount 16. A shaft insertion portion 20 (see FIG. 7) into which the drive shaft 52 (or the drive shaft 82) can be inserted is formed inside the drive shaft housing 19.

The drive shaft housing 19 is supported by a swivel bracket 26 so as to be rotatable in a horizontal direction. The swivel bracket 26 is coupled to a clamp bracket 27. The user can attach the outboard motor main body 11 to the ship by attaching the clamp bracket 27 to a transom of the ship. In addition, since the drive shaft housing 19 is supported by the swivel bracket 26 so as to be rotatable in the horizontal direction, the user can change an orientation of the outboard motor main body 11 in a left-right direction with respect to the ship.

The heat sink case 21 is a cylindrical member extending in the upper-lower direction. The heat sink case 21 is disposed below the drive shaft housing 19 and is coupled to a lower portion of the drive shaft housing 19. A shaft insertion portion 22 (see FIG. 7) into which the drive shaft 52 (or the drive shaft 82) can be inserted is formed inside the heat sink case 21. The shaft insertion portion 22 communicates with the shaft insertion portion 20 of the drive shaft housing 19. An anti-cavitation plate 28 is provided on a rear side of a lower portion of the heat sink case 21. The drive shaft housing 19 and the heat sink case 21 are specific examples of a "first housing part".

(Cooling Device)

Figure 3:
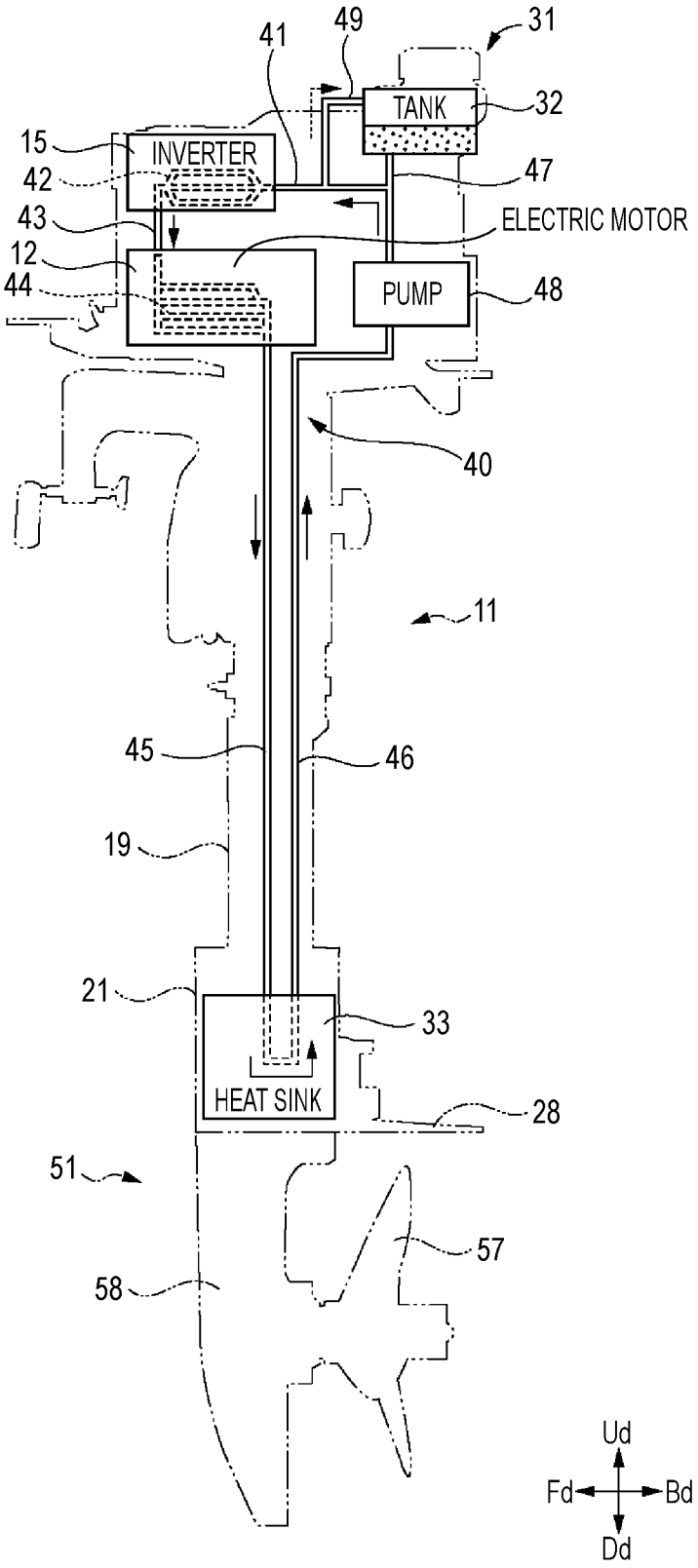
FIG. 3 is a view schematically showing a cooling structure of the outboard motor main body according to the embodiment of the present invention.

FIG. 3 schematically shows a cooling structure in the outboard motor main body 11. As described above, the outboard motor main body 11 includes the cooling device 31 that cools the electric motor 12 and the inverter 15. The cooling device 31 includes the tank 32 that stores cooling liquid, the heat sink 33 that cools the cooling liquid, the cooling liquid passage 40 that connects the inverter 15, the electric motor 12, and the heat sink 33 so that the cooling liquid circulates through the inverter 15, the electric motor 12, and the heat sink 33. and the pump 48 that flows the cooling liquid into the cooling liquid passage 40. The cooling liquid is, for example, an antifreeze solution containing ethylene glycol as a main component.

The tank 32 is formed of, for example, a resin material in a box shape. An injection port for injecting the cooling liquid is formed in an upper portion of the tank 32. A tank cap 32A that closes the injection port is detachably attached to the upper portion of the tank 32. The pump 48 is disposed below the tank 32. The heat sink 33 is provided in the heat sink case 21.

The cooling liquid passage 40 includes a transport passage 41 through which the cooling liquid is sent from the pump 48 to the inverter 15, an internal passage 42 through which the cooling liquid flows around or inside the inverter 15 in order to cool the inverter 15, a transport passage 43 through which the cooling liquid is sent from the inverter 15 to the electric motor 12, an internal passage 44 through which the cooling liquid flows around or inside the electric motor 12 in order to cool the electric motor 12, a cooling liquid pipe 45 through which the cooling liquid is sent from the electric motor 12 to the heat sink 33, a cooling liquid pipe 46 through which the cooling liquid is sent from the heat sink 33 to the pump 48, and a supply passage 47 through which the cooling liquid is supplied from the tank 32 to the transport passage 41 when the cooling liquid is insufficient. As a whole, the cooling liquid passage 40 has a closed loop structure including the transport passage 41, the internal passage 42, the transport passage 43, the internal passage 44, the cooling liquid pipe 45, an inside of the heat sink 33, and the cooling liquid pipe 46.

Each of the transport passages 41 and 43 and the supply passage 47 is formed of, for example, a pipe or a hose. The internal passage 42 is formed by, for example, a passage (water jacket) or the like formed in a wall portion forming an outline of the inverter 15. The internal passage 44 is formed by, for example, a passage (water jacket) or the like formed in a wall portion forming an outline of the electric motor 12. Each of the cooling liquid pipes 45 and 46 is, for example, a pipe made of resin or metal.

The cooling liquid stored in the tank 32 flows into the transport passage 41 and the like due to gravity. When the pump 48 is operated, the cooling liquid circulates through the transport passage 41, the internal passage 42, the transport passage 43, the internal passage 44, the cooling liquid pipe 45, the inside of the heat sink 33, and the cooling liquid pipe 46 in this order.

In addition, the cooling device 31 includes an air vent passage 49 for allowing air in the cooling liquid passage 40 to escape to an outside of the cooling liquid passage 40. One end side of the air vent passage 49 is connected to a portion disposed at a highest position in the cooling liquid passage 40, for example, to a middle of the transport passage 41. The other end side of the air vent passage 49 is connected to the upper portion of the tank 32, and is opened in a space in the tank 32 above a water surface of the cooling liquid stored in the tank 32. The air vent passage 49 is formed of, for example, a pipe or a hose. Air in the cooling liquid passage 40 is discharged to an upper space in the tank 32 through the air vent passage 49.

(Cooling Liquid Pipe)

Figure 4:
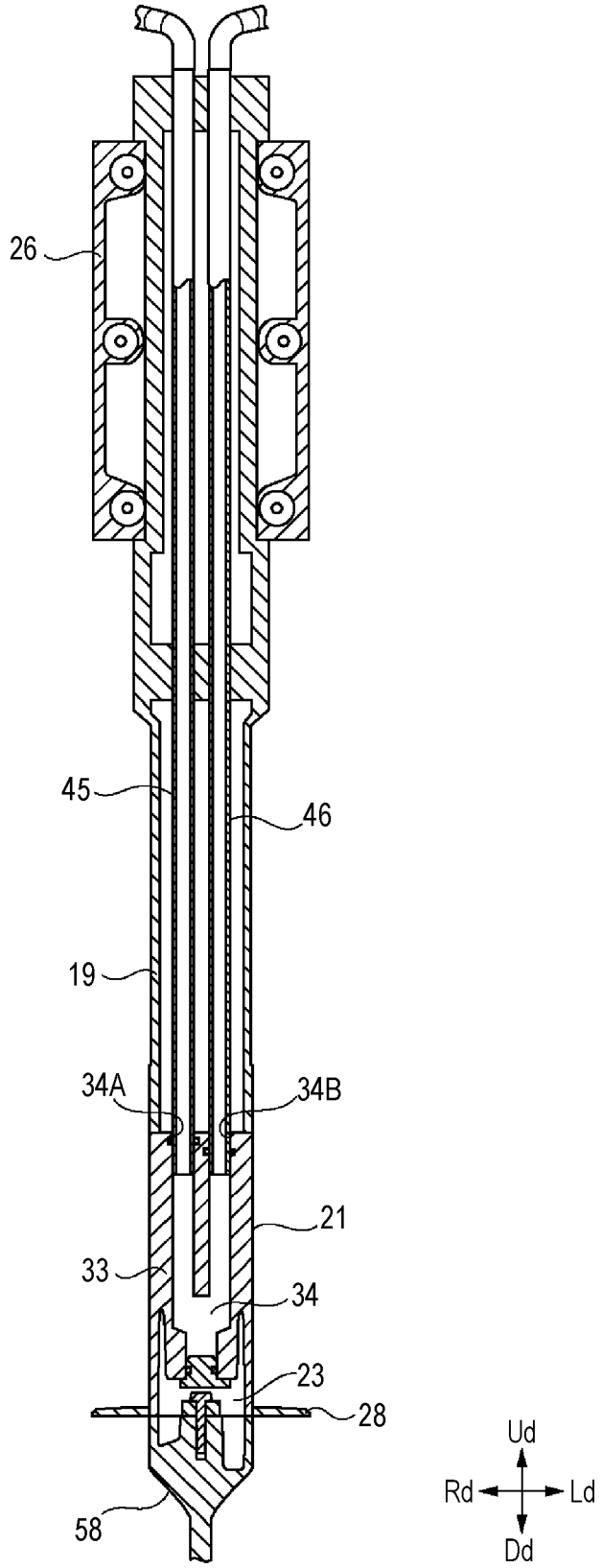
FIG. 4 is a cross-sectional view showing a state in which a cross section of a swivel bracket, a drive shaft housing, a cooling liquid pipe, a heat sink case, and a heat sink taken along a cutting line IV-IV in FIG. 2 is viewed from a front side thereof.

FIG. 4 shows a state in which a cross section of the swivel bracket 26, the drive shaft housing 19, the cooling liquid pipes 45 and 46, the heat sink case 21, and the heat sink 33 taken along a cutting line IV-IV in FIG. 2 is viewed from a front side (left side in FIG. 2) thereof. As shown in FIG. 4, the cooling liquid pipes 45 and 46 are formed by long pipes extending in the upper-lower direction. The cooling liquid pipes 45 and 46 penetrate an inside of the drive shaft housing 19. In the drive shaft housing 19, the cooling liquid pipes 45 and 46 are disposed parallel to each other in the left-right direction, and are disposed in a region close to a rear in the drive shaft housing 19.

(Heat Sink)

Figure 5:
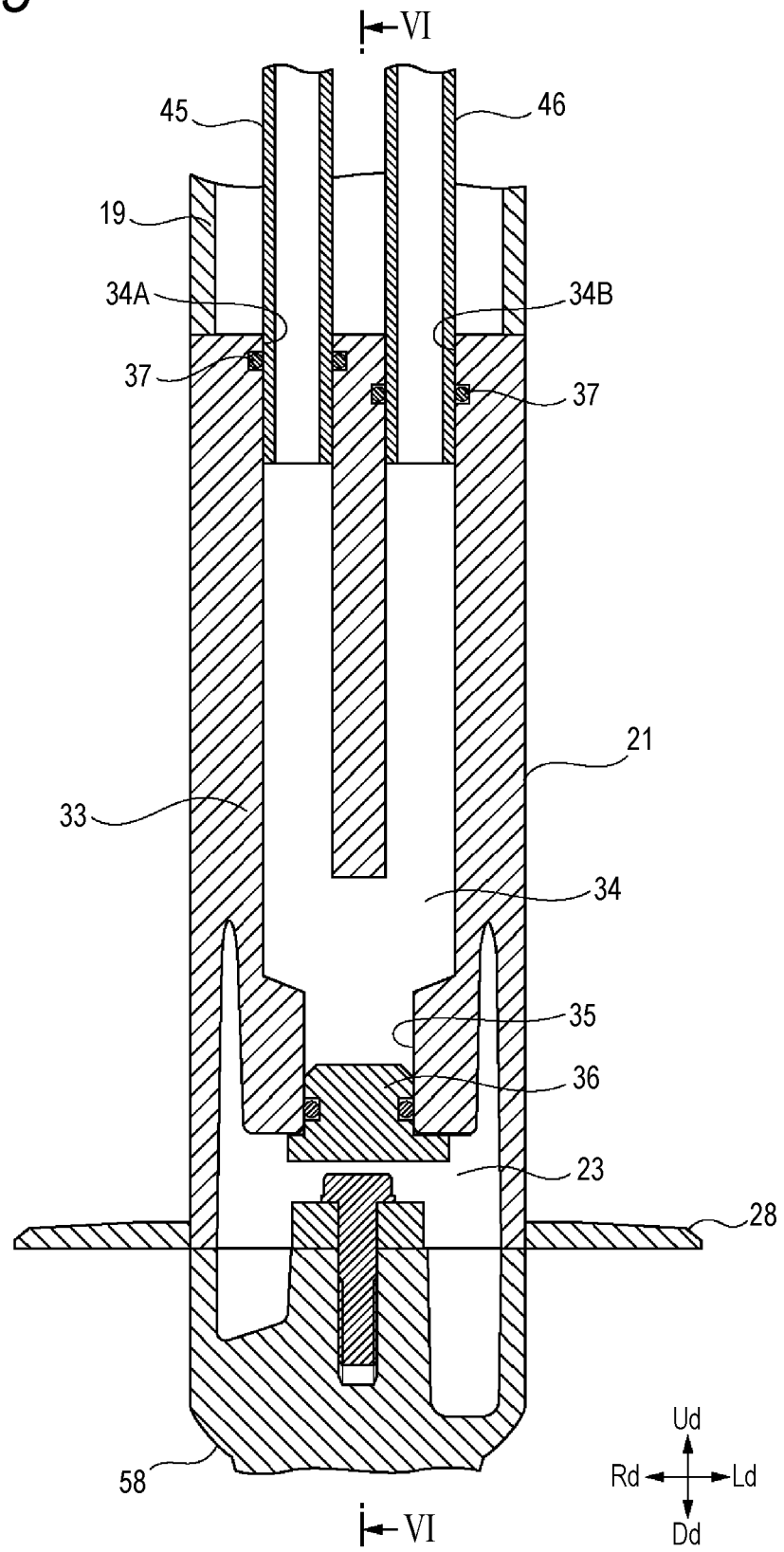
FIG. 5 is an enlarged cross-sectional view showing the heat sink case and the heat sink in FIG. 4.
Figure 6:
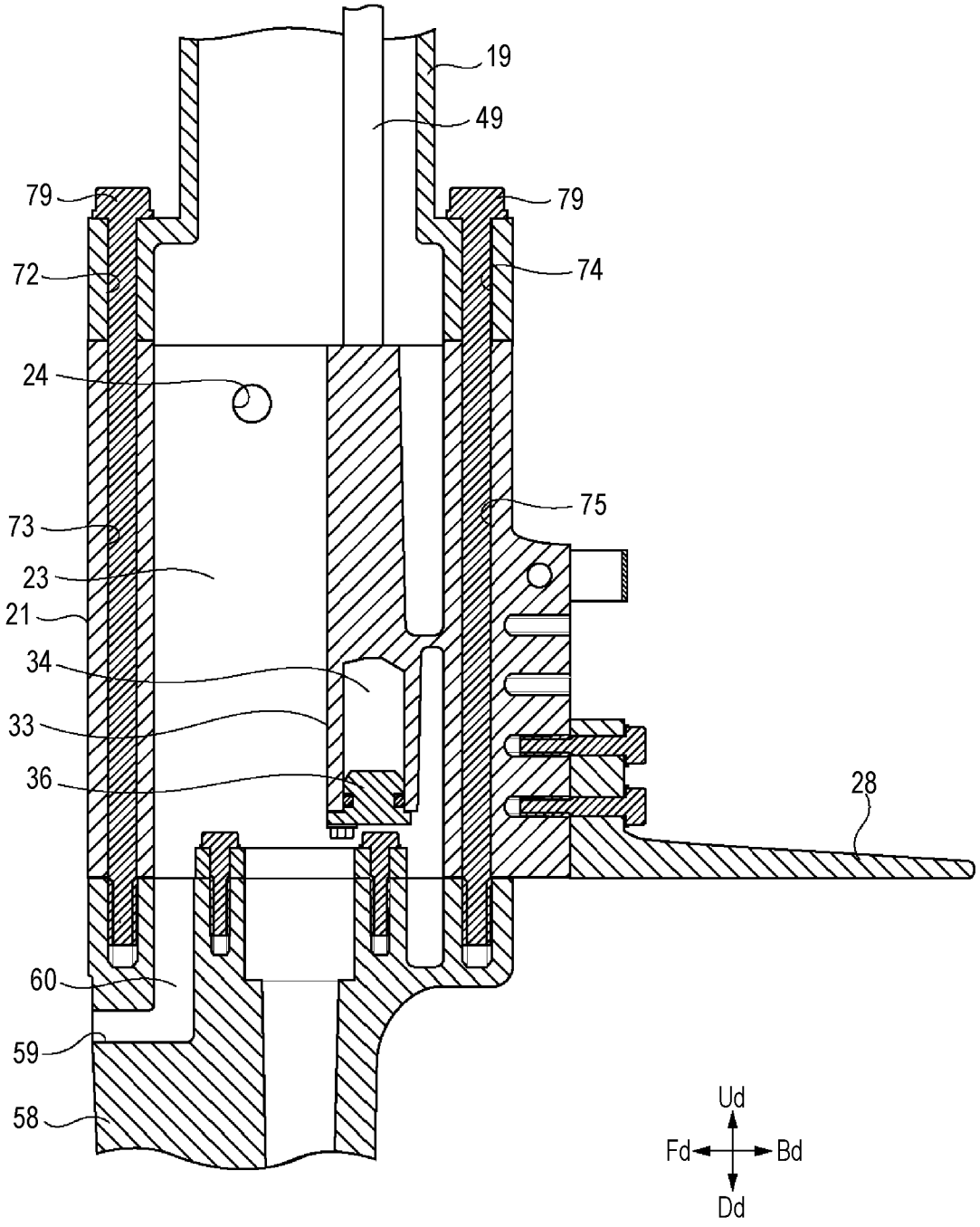
FIG. 6 is a cross-sectional view showing a state in which a cross section of the heat sink case and the heat sink taken along a cutting line VI-VI in FIG. 5 is viewed from a left side thereof.

FIG. 5 shows an enlarged view of the heat sink case 21 and the heat sink 33 in FIG. 4. FIG. 6 shows a state in which a cross section of the heat sink case 21 and the heat sink 33 taken along a cutting line VI-VI in FIG. 5 is viewed from a left side thereof (right side in FIG. 5). FIG. 6 shows a state in which the drive shaft 52 is not inserted.

The heat sink 33 is housed in the heat sink case 21. In the present embodiment, as shown in FIG. 5, the heat sink 33 is integrally formed with the heat sink case 21. The heat sink 33 and the heat sink case 21 are formed of a material having excellent heat dissipation, such as aluminum, and not only the heat sink 33 but also the heat sink case 21 has an excellent heat dissipation function. In addition, as shown in FIG. 6, the heat sink 33 is disposed in a region close to a rear in the heat sink case 21.

As shown in FIG. 5, a cooling pipeline 34 is provided inside the heat sink 33. The cooling pipeline 34 has a structure in which lower end sides of two pipelines that are disposed in the left-right direction and extend in the upper-lower direction are connected to each other, and is formed in a substantially U shape in an overall view. A cooling liquid inlet 34A is formed at one end of the cooling pipeline 34, and a cooling liquid outlet 34B is formed at the other end of the cooling pipeline 34. Although a hole 35 is formed in a lower portion of the cooling pipeline 34 for convenience of molding, the hole 35 is liquid-tightly closed by a closing member 36 having a sealing function.

A lower end portion of a cooling liquid pipe 45 is connected to the cooling liquid inlet 34A. Specifically, the lower end portion of the cooling liquid pipe 45 is inserted into the cooling liquid inlet 34A, and a gap between the cooling liquid inlet 34A and the lower end portion of the cooling liquid pipe 45 is liquid-tightly sealed by a seal 37 such as an O-ring. A lower end portion of a cooling liquid pipe 46 is connected to the cooling liquid outlet 34B. Specifically, the lower end portion of the cooling liquid pipe 46 is inserted into the cooling liquid outlet 34B, and a gap between the cooling liquid outlet 34B and the lower end portion of the cooling liquid pipe 46 is liquid-tightly sealed by the seal 37 such as an O-ring.

The cooling liquid passes from the internal passage 44 through an inside of the cooling liquid pipe 45, and flows from the cooling liquid inlet 34A into the cooling pipeline 34. The cooling liquid flowing into the cooling pipeline 34 flows through the cooling pipeline 34, flows out from the cooling liquid outlet 34B, enters the cooling liquid pipe 46, and reaches the pump 48 through the cooling liquid pipe 46.

In addition, the heat sink case 21 has a structure in which water (seawater, lake water, or the like) around the ship is circulated inside, and the heat sink 33 is cooled by the water. That is, as shown in FIG. 6, in the heat sink case 21, a flow chamber 23, which is a space for circulating water, is formed between the heat sink 33 and an outer wall portion of the heat sink case 21.

The lower portion of the heat sink case 21 is closed by a gear case 58 of the propeller propulsion module 51 as a whole by attaching the propeller propulsion module 51 to the heat sink case 21. However, the gear case 58 is provided with a water intake passage 60 for taking water into the flow chamber 23 in the heat sink case 21. One end side of the water intake passage 60 is connected to a water intake port 59 opened in a front portion of the gear case 58, and the other end side of the water intake passage 60 communicates with an inside of the flow chamber 23.

In addition, discharge ports 24 for discharging the water flowing through the flow chamber 23 to an outside of the flow chamber 23 are respectively formed in outer wall portions on both left and right sides of the heat sink case 21. Each discharge port 24 is disposed in an upper portion of the heat sink case 21.

At the time of sailing of the ship, the pump 48 is operated. Accordingly, the cooling liquid flows through the cooling liquid passage 40 and circulates in the inverter 15, the electric motor 12, and the heat sink 33 while passing through the inverter 15, the electric motor 12, and the heat sink 33. As a result, the inverter 15 and the electric motor 12 are cooled by the cooling liquid. In addition, since the water intake port 59 of the gear case 58 of the propeller propulsion module 51 is submerged below the water surface, at the time of sailing of the ship, water around the ship is taken into the flow chamber 23 via the water intake port 59 and the water intake passage 60, flows through the flow chamber 23, and is then discharged from each discharge port 24 to the outside of the flow chamber 23. The water taken into the flow chamber 23 hits the heat sink 33 to cool the heat sink 33. The cooling liquid that receives heat from the inverter 15 and the electric motor 12 is cooled by flowing through the cooling pipeline 34 of the heat sink 33. In addition, when the heat sink case 21 is submerged below the water surface, water hits an outer surface of the heat sink case 21, so that the heat sink case 21 and the heat sink 33 are cooled.

(Propeller Propulsion Module)

Figure 7:
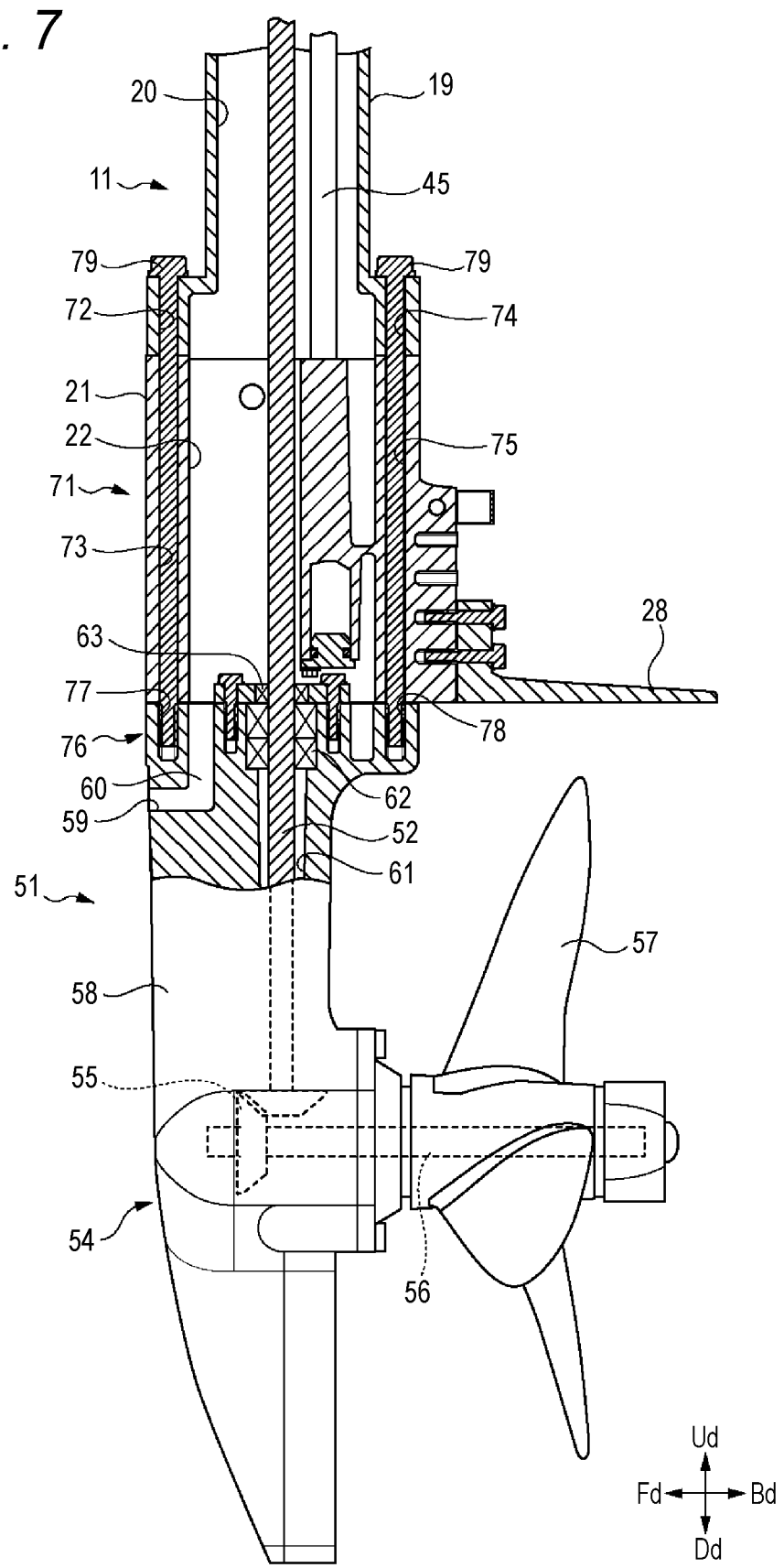
FIG. 7 is a view showing the propeller propulsion module attached to the outboard motor main body according to the embodiment of the present invention.

FIG. 7 shows the propeller propulsion module 51 attached to the outboard motor main body 11. As described above, the propeller propulsion module 51 includes the drive shaft 52, the propeller propulsion device 54, and the attachment bolts 79. In FIG. 7, the drive shaft 52 extends in the upper-lower direction and is rotated by the power of the electric motor 12. The propeller propulsion device 54 includes a gear mechanism 55 to which a lower end side of the drive shaft 52 is connected, a propeller shaft 56 extending in the front-rear direction and connected to the gear mechanism 55, the propeller 57 attached to a rear end side portion of the propeller shaft 56, and the gear case 58 housing the gear mechanism 55 and a front end side portion of the propeller shaft 56. The gear case 58 is provided with the water intake port 59 and the water intake passage 60 described above. The gear case may be referred to as a lower case. The drive shaft 52 is a specific example of a "first drive shaft", and the gear case 58 is a specific example of a "second housing part".

A lower end side portion of the drive shaft 52 is rotatably mounted in a shaft mounting portion 61 provided in the gear case 58 via a bearing 62. A seal 63 seals between the lower end side portion of the drive shaft 52 and an upper end side portion of the shaft mounting portion 61.

The propeller propulsion module 51 is attached to the outboard motor main body 11 by attaching an upper portion of the gear case 58 to a lower portion of the heat sink case 21 of the outboard motor main body 11. The heat sink case 21 and the gear case 58 are respectively provided with attachment mechanisms 71 and 76 to which the upper portion of the gear case 58 can be detachably attached to the lower portion of the heat sink case 21. The attachment mechanism 71 on a heat sink case 21 side has bolt insertion holes 72 and 74 formed in a front portion and a rear portion of the lower portion of the drive shaft housing 19, respectively, and bolt insertion holes 73 and 75 formed in a front portion and a rear portion of the heat sink case 21. respectively. The attachment mechanism 76 on a gear case 58 side has bolt holes 77 and 78 formed in a front portion and a rear portion of the upper portion of the gear case 58, respectively. One of the two attachment bolts 79 is inserted into the bolt insertion holes 72 and 73 and fastened to the bolt hole 77, and the other attachment bolt 79 is inserted into the bolt insertion holes 74 and 75 and fastened to the bolt hole 78, so that the gear case 58 is attached and fixed to the heat sink case 21.

Figure 8:
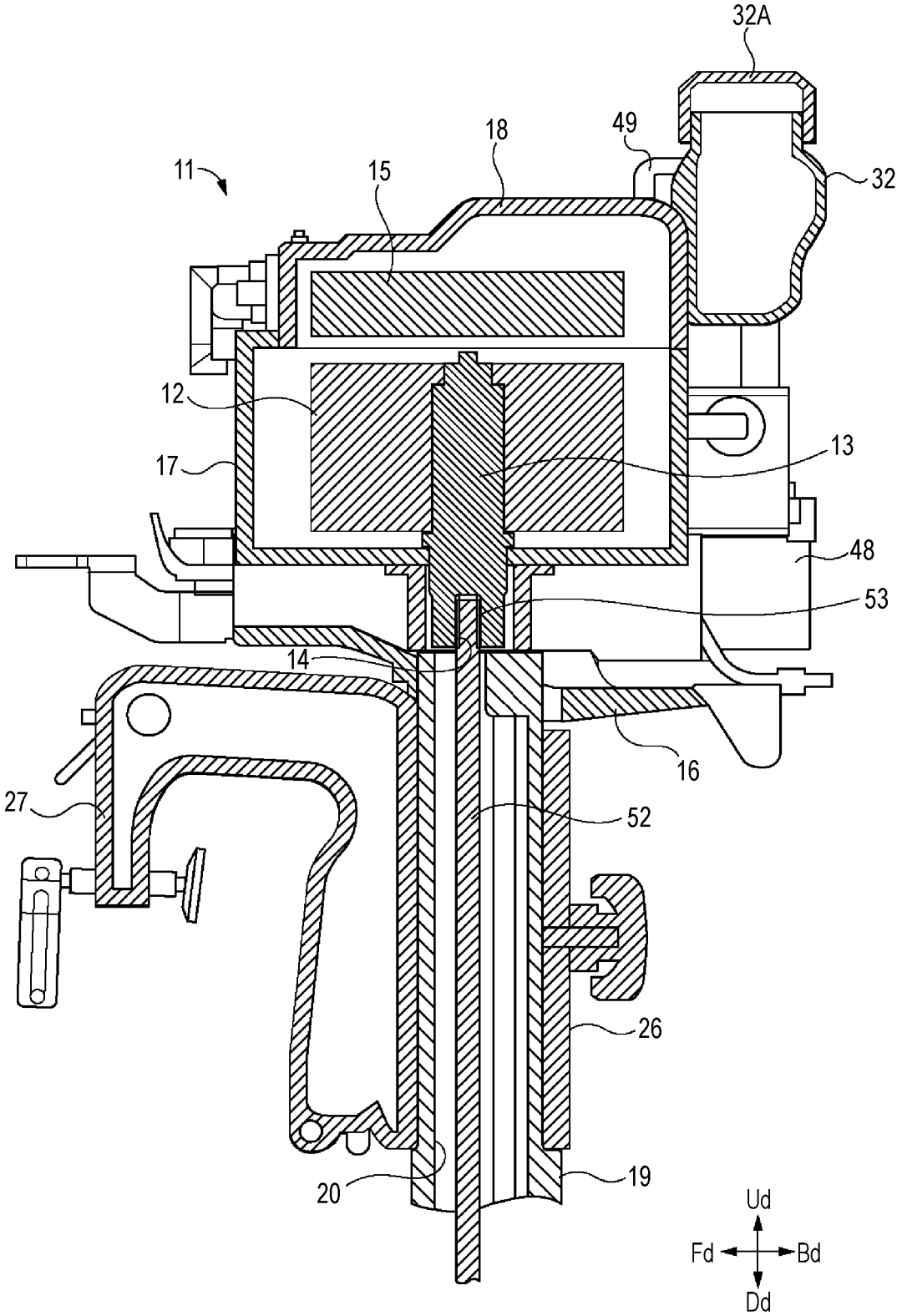
FIG. 8 is a cross-sectional view showing a state in which a cross section of an electric motor, a motor case, and the like of the outboard motor main body according to the embodiment of the present invention cut by a plane including an axial center of an output shaft of the electric motor and extending in an upper-lower direction and a front-rear direction is viewed from a left side thereof.

In addition, the drive shaft 52 mounted in the shaft mounting portion 61 in the gear case 58 is inserted into the shaft insertion portion 22 formed inside the heat sink case 21 and the shaft insertion portion 20 formed inside the drive shaft housing 19, and is disposed in a substantially central region in the front-rear direction and the left-right direction in the shaft insertion portions 22 and 20 (a position in front of the cooling liquid pipes 45 and 46 and the heat sink 33). An upper end portion of the drive shaft 52 is connected to the output shaft 13 of the electric motor 12. FIG. 8 shows a state in which a cross section of the electric motor 12, the motor case 17, and the like of the outboard motor main body 11 cut by a plane including an axial center of the output shaft 13 of the electric motor 12 and extending in the upper-lower direction and the front-rear direction is viewed from a left side thereof. In FIG. 8, a connection mechanism that separably connects the output shaft 13 and the drive shaft 52 is provided at a lower end portion of the output shaft 13 of the electric motor 12 and the upper end portion of the drive shaft 52. That is, a spline 53 as the connection mechanism on a drive shaft 52 side is formed on the upper end portion of the drive shaft 52. A spline hole 14 as the connection mechanism on an output shaft side is formed in the lower end portion of the output shaft 13. The drive shaft 52 and the output shaft 13 are connected to each other by fitting the spline 53 of the drive shaft 52 into the spline hole 14 of the output shaft 13. Accordingly, the drive shaft 52 rotates in accordance with rotation of the output shaft 13.

The user can attach the propeller propulsion module 51 to the outboard motor main body 11 as follows. First, the user inserts the drive shaft 52 supported by the gear case 58 into the shaft insertion portion 22 of the heat sink case 21 from below the heat sink case 21, and further inserts the drive shaft 52 into the shaft insertion portion 20 in the drive shaft housing 19. Next, the user fits the spline 53 of the drive shaft 52 into the spline hole 14 of the output shaft 13 of the electric motor 12. Next, the user passes one of the two attachment bolts 79 through the bolt insertion holes 72 and 73 and fastens the attachment bolt 79 to the bolt hole 77, and passes the other attachment bolt 79 through the bolt insertion holes 74 and 75 and fastens the attachment bolt 79 to the bolt hole 78, thereby attaching the gear case 58 to the heat sink case 21.

In addition, the user can remove the propeller propulsion module 51 from the outboard motor main body 11 as follows. First, the user loosens the two attachment bolts 79 and removes the two attachment bolts 79 from the bolt holes 77 and 78. Next, the user slightly separates the propeller propulsion module 51 from the outboard motor main body 11. Accordingly, the spline 53 of the drive shaft 52 is disengaged from the spline hole 14. Next, the user further separates the propeller propulsion module 51 from the outboard motor main body 11, and pulls out the drive shaft 52 from the shaft insertion portions 22 and 20.

(Water Jet Propulsion Module)

Figure 9A:
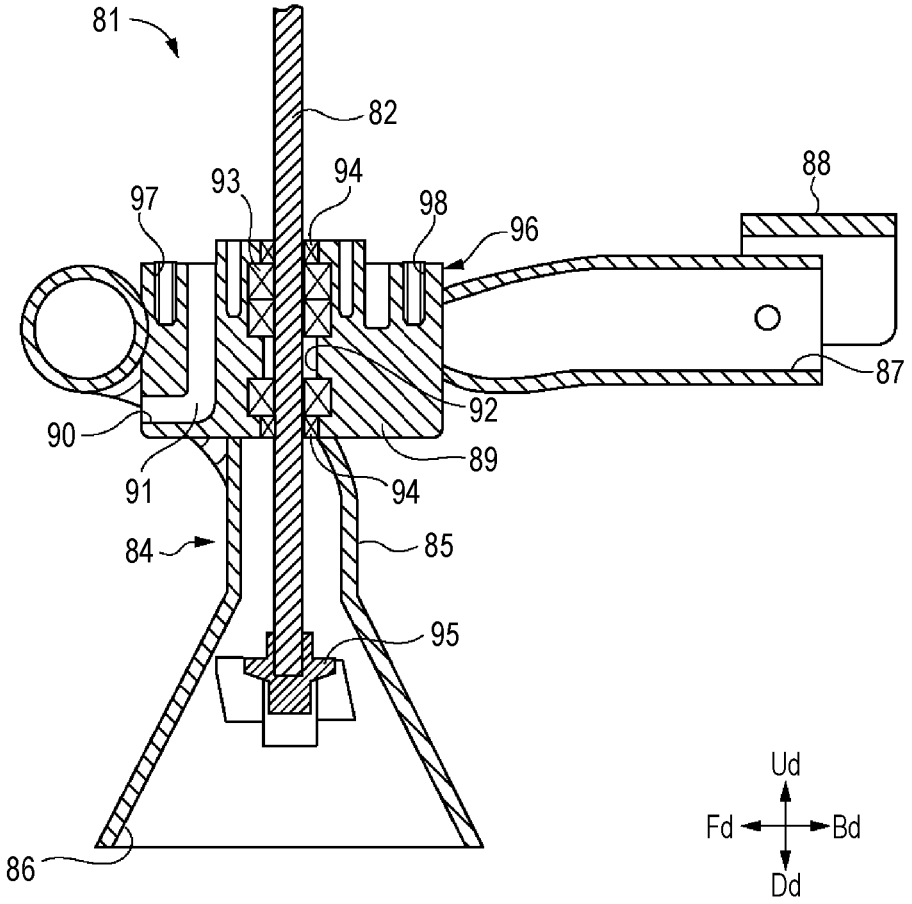
Figure 9B:
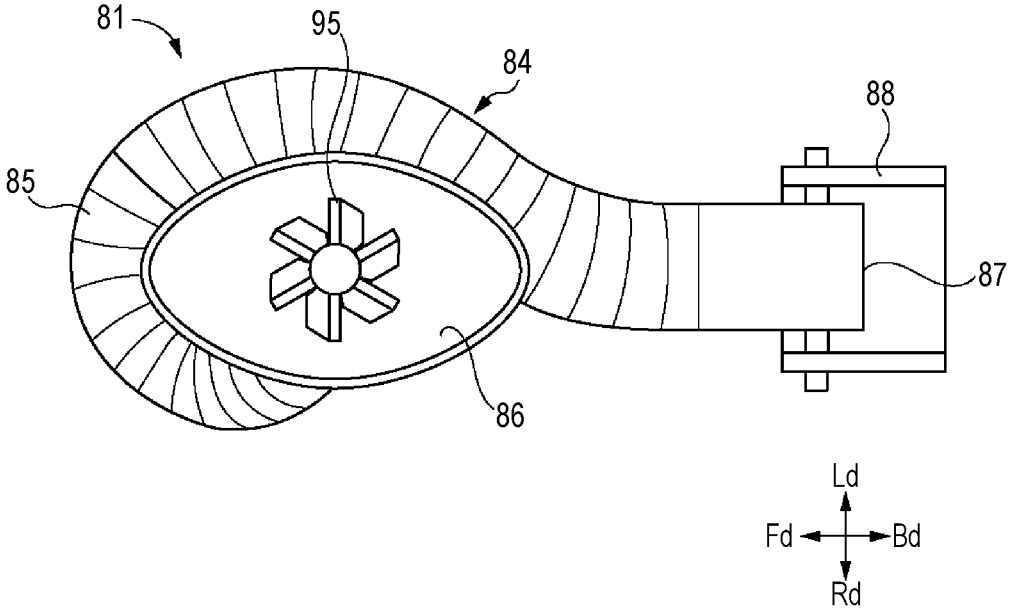

FIG. 9A shows a state in which a cross section of the water jet propulsion module 81 cut by a plane including the axial center of the drive shaft 82 and extending in the upper-lower direction and the front-rear direction is viewed from a left side thereof. FIG. 9B shows a state in which the water jet propulsion module 81 is viewed from a lower side thereof.

As described above, the water jet propulsion module 81 includes the drive shaft 82, the water jet propulsion device 84, and the attachment bolts 99 (see FIG. 1A). In FIGS. 9A and 9B, the drive shaft 82 extends in the upper-lower direction and is rotated by the power of the electric motor 12. The water jet propulsion device 84 includes the duct 85, a duct support portion 89 that supports the duct 85, and the impeller 95 that is provided in the duct 85 and rotates by rotation of the drive shaft 82 to generate a jet flow. The drive shaft 82 is a specific example of a "second drive shaft".

The duct support portion 89 has, for example, a columnar outer shape, and is formed integrally with the duct 85. The duct 85 is formed in a cylindrical shape. The duct 85 extends upward from below the duct support portion 89, and then extends so as to draw an arc clockwise around the duct support portion 89 when the duct 85 is viewed from below, and then extends rearward. In addition, a lower end side portion of the duct 85 is enlarged in diameter, and a water intake port 86 is formed in a lower end portion of the duct 85. A drain port 87 is formed at a rear end portion of the duct 85. In addition, a folded-back plate 88 is attached to a rear end side portion of the duct 85, and the folded-back plate 88 covers an upper side of the drain port 87.

In addition, the duct support portion 89 is provided with a shaft mounting portion 92 that passes through a center of the duct support portion 89 in the upper-lower direction. A lower end side portion of the drive shaft 82 is rotatable mounted in the shaft mounting portion 92 via a bearing 93. A seal 94 seals between the lower end side portion of the drive shaft 82 and an upper end portion of the shaft mounting portion 92, and the seal 94 seals between the lower end side portion of the drive shaft 82 and a lower end portion of the shaft mounting portion 92.

A lower end of the shaft mounting portion 92 communicates with an inside of the duct 85. A lower end portion of the drive shaft 82 is disposed in the duct 85, and the impeller 95 is attached to the lower end portion of the drive shaft 82.

The duct support portion 89 is provided with a water intake passage 91 for taking water into the flow chamber 23 of the heat sink case 21. One end side of the water intake passage 91 is connected to a water intake port 90 opened in a front portion of the duct support portion 89. The other end side of the water intake passage 91 communicates with the inside of the flow chamber 23 when the water jet propulsion module 81 is attached to the outboard motor main body 11.

The water jet propulsion module 81 is attached to the outboard motor main body 11 by attaching an upper portion of the duct support portion 89 to the lower portion of the heat sink case 21 of the outboard motor main body 11. The duct support portion 89 is provided with an attachment mechanism 96 to which the upper portion of the duct support portion 89 can be detachably attached to the lower portion of the heat sink case 21. The attachment mechanism 96 has bolt holes 97 and 98 formed in a front portion and a rear portion of the upper portion of the duct support portion 89, respectively. The attachment mechanism 96 has the same configuration as the attachment mechanism 76 in the propeller propulsion module 51. That is, the number, an arrangement, inner diameters, and the like of the bolt holes 97 and 98 in the attachment mechanism 96 are the same as the number, an arrangement, inner diameters, and the like of the bolt holes 77 and 78 in the attachment mechanism 76 of the propeller propulsion module 51. The attachment bolts 99 that are the same as the attachment bolts 79 of the propeller propulsion module 51 are used. A method of attaching the duct support portion 89 to the heat sink case 21 is the same as a method of attaching the gear case 58 of the propeller propulsion module 51 to the heat sink case 21. That is, one of the two attachment bolts 99 is inserted into the bolt insertion hole 72 of the drive shaft housing 19 and the bolt insertion hole 73 of the heat sink case 21 and fastened to the bolt hole 97, and the other attachment bolt 99 is inserted into the bolt insertion hole 74 of the drive shaft housing 19 and the bolt insertion hole 75 of the heat sink case 21 and fastened to the bolt hole 98. so that the duct support portion 89 is attached and fixed to the heat sink case 21.

Similarly to the drive shaft 52 in the propeller propulsion module 51, the drive shaft 82 mounted in the shaft mounting portion 92 of the duct support portion 89 is inserted into the shaft insertion portion 22 formed inside the heat sink case 21 and the shaft insertion portion 20 formed inside the drive shaft housing 19. An upper end portion of the drive shaft 82 is connected to the output shaft 13 of the electric motor 12. A length of a portion of the drive shaft 82 protruding upward from the duct support portion 89 is the same as a length of a portion of the drive shaft 52 of the propeller propulsion module 51 protruding upward from the gear case 58. A spline 83 (see FIG. 1A), which is the same as the spline 53 formed on the upper end portion of the drive shaft 52 of the propeller propulsion module 51, is formed on the upper end portion of the drive shaft 82.

The user can attach the water jet propulsion module 81 to the outboard motor main body 11 by the same method as a method of attaching the propeller propulsion module 51 to the outboard motor main body 11. In addition, the user can remove the water jet propulsion module 81 from the outboard motor main body 11 by the same method as a method of removing the propeller propulsion module 51 from the outboard motor main body 11.

As described above, according to the outboard motors 2 and 3 or the outboard motor set 1 of the embodiment of the present invention, the user can form the propeller outboard motor 2 by attaching the propeller propulsion module 51 to the outboard motor main body 11, and can form the water jet outboard motor 3 by attaching the water jet propulsion module 81 to the outboard motor main body 11. For example, when a sailing area is a deep water area, the user attaches the propeller propulsion module 51 to the outboard motor main body 11 to form the propeller outboard motor 2, and attaches the propeller outboard motor 2 to the transom of the ship to sail. Accordingly, the user can sail at a high speed based on the high propulsion efficiency of the propeller propulsion device 54. On the other hand, when the sailing area is a shallow water area, the user forms the water jet outboard motor 3 by attaching the water jet propulsion module 81, instead of the propeller propulsion module 51, to the outboard motor main body 11, and attaches the water jet outboard motor 3 to the transom of the ship to sail. Accordingly, when the propeller propulsion device 54 is used, the user can sail even in an area where the water depth is so shallow that a blade of a propeller hits a water bottom.

In addition, according to the outboard motors 2 and 3 or the outboard motor set 1 of the present embodiment, since all components of the cooling device 31 other than the water intake passage 60 and the water intake port 59 (or the water intake passage 91 and the water intake port 90) are provided in the outboard motor main body 11, the user can easily attach and detach the propulsion module 51 or 81 to and from the outboard motor main body 11. That is, by separating the propulsion module 51 or 81 from the outboard motor main body 11, the components of the cooling device 31 other than the water intake passage 60 and the water intake port 59 (or the water intake passage 91 and the water intake port 90) are not divided into an outboard motor main body 11 side and a propulsion module 51 or 81 side. Therefore, for example, when the propulsion module 51 or 81 separated from the outboard motor main body 11 is attached to the outboard motor main body 11, the user does not need to perform a complicated operation of carefully connecting a cooling liquid pipe provided on an outboard motor main body side and a cooling liquid pipe provided on the propulsion module 51 or 81 side to each other with their positions accurately aligned with each other. In addition, in the outboard motors 2 and 3 or the outboard motor set 1 of the present embodiment, although the water intake passage 60 and the water intake port 59, which are components of the cooling device 31, are provided in the propeller propulsion module 51, the other end side of the water intake passage 60 communicates with the flow chamber 23 in the heat sink case 21 only by attaching the propeller propulsion module 51 to the outboard motor main body 11, so that by providing the water intake passage 60 and the water intake port 59 in the propeller propulsion module 51, an attachment operation of the propeller propulsion module 51 to the outboard motor main body 11 by the user is not complicated or difficult. Similarly, although the water intake passage 91 and the water intake port 90, which are components of the cooling device 31, are provided in the water jet propulsion module 81, the other end side of the water intake passage 91 communicates with the flow chamber 23 in the heat sink case 21 only by attaching the water jet propulsion module 81 to the outboard motor main body 11, so that by providing the water intake passage 91 and the water intake port 90 in the water jet propulsion module 81, an attachment operation of the water jet propulsion module 81 to the outboard motor main body 11 by the user is not complicated or difficult.

In addition, the outboard motors 2 and 3 or the outboard motor set 1 of the present embodiment includes the connection mechanism (the spline hole 14, the spline 53, and the spline 83) that separably connects the output shaft 13 of the electric motor 12 and the drive shaft 52 or 82. In addition, the outboard motors 2 and 3 or the outboard motor set 1 of the present embodiment includes the attachment mechanisms 71, 76, and 96 that detachably attach the propulsion module 51 or 81 to the lower portion of the heat sink case 21 of the outboard motor main body 11. Further, the outboard motors 2 and 3 or the outboard motor set 1 of the present embodiment includes the shaft insertion portions 20 and 22 into which the drive shaft 52 or 82 is removably inserted. According to these configurations, the user can easily attach and detach the propulsion module 51 or 81 to and from the outboard motor main body 11.

In the above embodiment, the attachment mechanism 76 of the propeller propulsion module 51 and the attachment mechanism 96 of the water jet propulsion module 81 have the same configuration, and the attachment bolt 79 of the propeller propulsion module 51 and the attachment bolt 99 of the water jet propulsion module 81 have the same configuration. However, as long as the propeller propulsion module 51 and the water jet propulsion module 81 can be selectively attached to the outboard motor main body 11, the attachment mechanisms thereof or the attachment bolts thereof may be different from each other. For example, the attachment mechanism 76 and the attachment bolt 79 of the propeller propulsion module 51 are as described in the above embodiment, while two bolt insertion holes penetrating the duct support portion 89 in the upper-lower direction may be formed as the attachment mechanism 96 of the water jet propulsion module 81, a bolt longer than the attachment bolt 79 of the propeller propulsion module 51 may be adopted as the attachment bolt 99, and when the duct support portion 89 is attached to the heat sink case 21, one of the two mounting bolts 99 may be passed through the bolt insertion hole 72 of the drive shaft housing 19, the bolt insertion hole 73 of the heat sink case 21, and one bolt insertion hole of the duct support portion 89, and then a nut may be fastened to the attachment bolt 99, and the other attachment bolt 99 may be passed through the bolt insertion hole 74 of the drive shaft housing 19, the bolt insertion hole 75 of the heat sink case 21, and the other bolt insertion hole of the duct support portion 89, and then a nut may be fastened to the attachment bolt 99.

Figure 10:
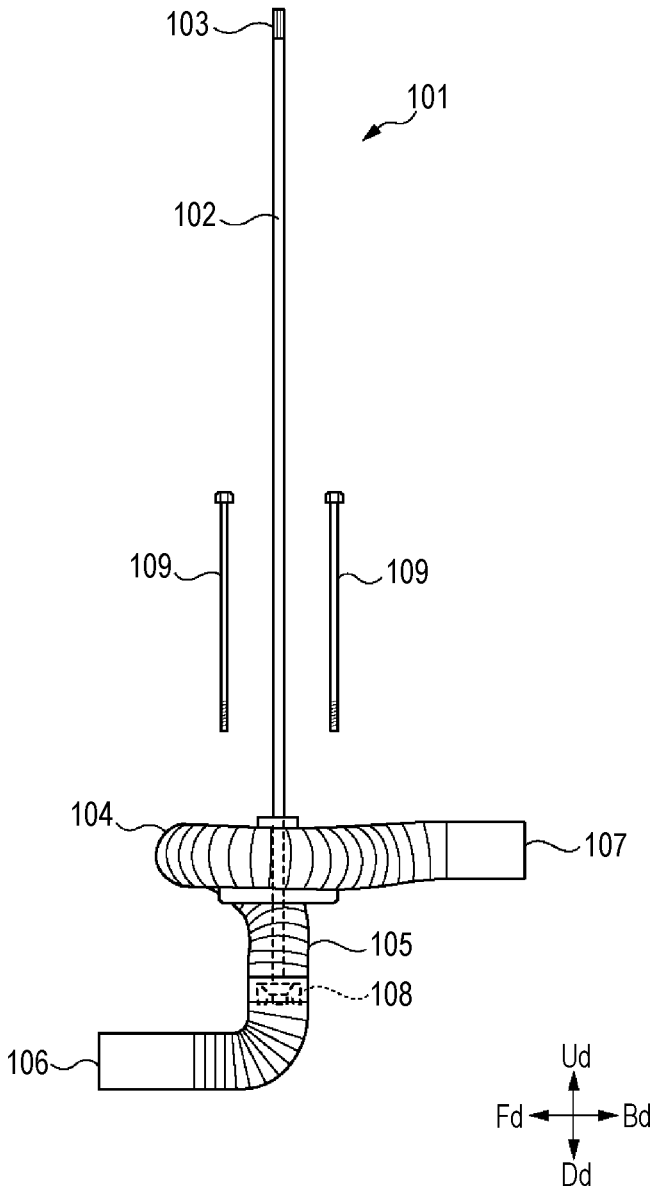
FIG. 10 is a view showing another propulsion module according to the embodiment of the present invention.

In addition, a water jet propulsion module 101 shown in FIG. 10 may be added to the propeller propulsion module 51 and the water jet propulsion module 81 shown in FIG. 1, or one of the propeller propulsion module 51 and the water jet propulsion module 81 shown in FIG. 1 may be replaced with the water jet propulsion module 101 shown in FIG. 10. Similarly to the water jet propulsion module 81 shown in FIG. 1, the water jet propulsion module 101 shown in FIG. 10 includes a drive shaft 102 that is rotated by the power of the electric motor 12 and has a spline 103 formed at an upper end portion of the drive shaft 102, a water jet propulsion device 104 that converts rotation of the drive shaft 102 into the propulsion force of the ship using a duct 105 and an impeller 108, and an attachment bolt 109 for attaching the water jet propulsion module 101 to the outboard motor main body 11. However, a configuration of the duct 105 is different from a configuration of the duct 85 of the water jet propulsion module 81. Specifically, in the duct 85 of the water jet propulsion module 81, the water intake port 86 faces downward, whereas in the duct 105 of the water jet propulsion module 101, a water intake port 106 faces forward. A drain port 107 faces rearward. According to the water jet propulsion module 101, since the water intake port 106 faces forward, the impeller 108 is rotated in a reverse direction to generate a jet flow in a reverse direction, so that a propulsion force for moving the ship rearward can be obtained.

In addition, a propulsion module having another configuration may be added to the outboard motor set 1, or any one of the propulsion modules 51, 81, and 101 of the outboard motor set 1 may be replaced with a propulsion module having another configuration.

In addition, in the present invention, the connection mechanism that separably connects the output shaft of the power source and the drive shaft is not limited to the spline hole and the spline described in the above embodiment, and may be, for example, gears attached to the output shaft of the power source and gears attached to an upper end side of the drive shaft.

In addition, the present invention can also be applied to an outboard motor using an internal combustion engine as the power source. The present invention is not limited to the outboard motor, and can also be applied to ship propulsion machines of other types such as an inboard-outboard motor.

In addition, the present invention can be changed as appropriate without departing from the scope or spirit of the invention which can be read from the claims and the entire specification, and the ship propulsion machine and the ship propulsion machine set to which such a change is applied are also included in the technical concept of the present invention.

What is claimed is:

1. A ship propulsion machine comprising:

a ship propulsion machine main body; and a propulsion module configured to generate a propulsion force of a ship using power generated by the ship propulsion machine main body, wherein the ship propulsion machine main body includes:

a power source;

a tank that stores cooling liquid that cools the power source;

a heat sink that cools the cooling liquid;

a cooling liquid passage connecting the power source and the heat sink such that the cooling liquid circulates between the power source and the heat sink;

a pump configured to cause the cooling liquid to flow in the cooling liquid passage;

a mount supporting the power source, the tank, and the pump; and a first housing part disposed below the mount and housing the heat sink, the propulsion module includes:

a drive shaft extending in an upper-lower direction and configured to be rotated by power of the power source; and a propulsion device connected to a lower end side of the drive shaft and configured to convert rotation of the drive shaft into the propulsion force of the ship, the first housing part is provided with a shaft insertion portion into which the drive shaft is removably inserted, a connection mechanism that separably connects an output shaft of the power source and the drive shaft is provided on the power source and on an upper end side of the drive shaft, and the first housing part and the propulsion device are provided with an attachment mechanism that detachably attaches the propulsion module to a lower portion of the first housing part.

2. The ship propulsion machine according to claim 1, wherein the propulsion device includes:

a gear mechanism to which the lower end side of the drive shaft is connected;

a propeller shaft connected to the gear mechanism;

a propeller attached to the propeller shaft; and a second housing part housing the gear mechanism and the propeller shaft.

3. The ship propulsion machine according to claim 1, wherein the propulsion device includes:

a duct; and an impeller provided in the duct and configured to be rotated by rotation of the drive shaft and to generate a jet flow.

4. A ship propulsion machine set comprising:

a ship propulsion machine main body;

a propeller propulsion module configured to generate a propulsion force of a ship using power generated by the ship propulsion machine main body; and a water jet propulsion module configured to generate the propulsion force of the ship using the power generated by the ship propulsion machine main body, in which the ship propulsion machine set is used by selecting one of the propeller propulsion module and the water jet propulsion module and attaching the selected module to the ship propulsion machine main body, wherein the ship propulsion machine main body includes:

a power source;

a tank configured to store cooling liquid that cools the power source;

a heat sink that cools the cooling liquid;

a cooling liquid passage connecting the power source and the heat sink such that the cooling liquid circulates between the power source and the heat sink;

a pump configured to cause the cooling liquid to flow in the cooling liquid passage;

a mount supporting the power source, the tank, and the pump; and a first housing part disposed below the mount and housing the heat sink, the propeller propulsion module includes:

a first drive shaft extending in an upper-lower direction and configured to be rotated by power of the power source;

a gear mechanism to which a lower end side of the first drive shaft is connected;

a propeller shall connected to the gear mechanism;

a propeller attached to the propeller shaft; and a second housing part housing the gear mechanism and the propeller shaft, the water jet propulsion module includes:

a second drive shaft extending in the upper-lower direction and configured to be rotated by the power of the power source;

a duct; and an impeller that is provided in the duct and configured to be rotated by rotation of the second drive shaft and to generate a jet flow, the first housing part is provided with a shaft insertion portion into which the first drive shaft and the second drive shaft are configured to be selectively inserted, a connection mechanism configured to selectively connect the first drive shaft and the second drive shaft to an output shaft of the power source is provided on the power source, an upper end side of the first drive shaft, and an upper end side of the second drive shaft, and the first housing part, the second housing part, and the duct are provided with an attachment mechanism to which the propeller propulsion module and the water jet propulsion module are configured to be selectively attached to a lower portion of the first housing part.

* * * * *